US010875161B2

(12) United States Patent
Guo

(10) Patent No.: US 10,875,161 B2
(45) Date of Patent: Dec. 29, 2020

(54) LOCKABLE TORQUE WRENCH WITH ADJUSTMENT INDICATION

(71) Applicant: OGC TORQUE CO., LTD., Taichung (TW)

(72) Inventor: Wun-Jin Guo, Taichung (TW)

(73) Assignee: OGC TORQUE CO., LTD., Taichung (TW)

( * ) Notice: Subject to any disclaimer, the term of this patent is extended or adjusted under 35 U.S.C. 154(b) by 214 days.

(21) Appl. No.: 16/055,423

(22) Filed: Aug. 6, 2018

(65) Prior Publication Data

US 2020/0039039 A1 Feb. 6, 2020

(51) Int. Cl.
*B25B 23/142* (2006.01)

(52) U.S. Cl.
CPC ..... *B25B 23/1427* (2013.01)

(58) Field of Classification Search
CPC .... B25B 23/1427; B25B 23/142; B25B 23/16
See application file for complete search history.

(56) References Cited

U.S. PATENT DOCUMENTS 5,497,682 A * 3/1996 Hsu ..... B25B 23/1427 81/478
8,863,624 B2 * 10/2014 Chen ..... B25B 23/1427 81/467
9,700,999 B2 * 7/2017 Hsieh ..... B25B 23/1427
10,611,006 B2 * 4/2020 Guo ..... B25B 13/463

FOREIGN PATENT DOCUMENTS

TW M515937 1/2016

* cited by examiner

*Primary Examiner* — Hadi Shakeri
(74) *Attorney, Agent, or Firm* — WPAT, PC

(57) ABSTRACT

A lockable torque wrench with adjustment indication includes a rod body, a handle, a plurality of rollers having a rolling pillar, a rotation ring, and a pressing member. The rod body is combined into the handle and rotatable to protrude or retract against the handle for adjusting the torque. The rotation ring is disposed on an extension tube of the handle and mounted around the rollers. The rotation ring is switched between a locked and a relax positions. The pressing member has combination portions at two sides of the extension tube, and permanently engages the rolling pillar. In an ascend position, the rolling pillar is pressed toward the rod body by the prestress force supporting the pressing member. When meeting a position limiting groove, the rolling pillar is pressed to lower in the position limiting groove, providing a switch sensation formed for the user.

7 Claims, 8 Drawing Sheets

LOCKABLE TORQUE WRENCH WITH ADJUSTMENT INDICATION

BACKGROUND OF THE INVENTION

1. Field of the Invention

The present invention relates to torque wrenches, and more particularly, to a lockable torque wrench with adjustment indication.

2. Description of the Related Art

Referring to TW patent M515937, a lock ring structure of torque wrench is disclosed, wherein the main body thereof comprises an inner tube externally mounted with an outer tube, and the outer tube comprises two positioning members and a position limiting member, with a lock ring mounted around the outer tube. The lock ring includes an inner ring and an outer ring. The inner ring has one allowance groove corresponding to each position limiting member. The inner ring has a position limiting groove corresponding to the position limiting member, with two position limiting blocks disposed in the position limiting groove. When the lock ring rotates with respect to the main body, the position limiting member is able to be engaged with either position limiting block. Also, the inner ring has a plurality of engagement blocks concavely disposed on the outer periphery of the inner ring, which are engaged with a plurality of engagement grooves disposed on the inner periphery of the outer ring. Therefore, the user is able to rotate to unclasp the lock ring, so as to rotate the inner tube with respect to the outer tube for adjusting the torque. After confirming the target torque, the user then rotates to lock the inner tube against the outer tube, facilitating the subsequent operation.

Regarding the torque wrench above, the outer tube is usually provided with a scale corresponding to the torque value, such that the user is allowed to visually confirm the current torque value during the torque adjusting process. However, when visually confirming the scale, a difference between the exact torque value and the visually acquired torque value scale may occur, causing an inaccurately adjusted torque, especially when the torque value scale is worn after a long-period usage.

SUMMARY OF THE INVENTION

For improving the issues above, a lockable torque wrench with adjustment indication is disclosed, wherein a switch sensation is provided during rotation of the rod body with respect to the handle as a torque adjustment indication.

A lockable torque wrench with adjustment indication in accordance with an embodiment comprises:

a rod body formed in an elongate rod and having a first end and a second end, with a driving head disposed at the first end, and a plurality of position limiting grooves disposed at an outer periphery of the rod body in adjacent to the second end, the plurality of position limiting grooves being circularly mounted around the rod body with an interval formed of a rod wall of the rod body disposed between each two of the position limiting grooves;

a handle having an extension tube at one end, the second end of the rod body passing through the extension tube to be combined into the handle, the rod body rotating with respect to the handle to extend or retract for adjusting a torque for the driving head to be operated with, the extension tube having a plurality of through holes, each of the through holes being arranged in alignment with each position limiting groove along with the rotation of the handle with respect to the rod body;

a plurality of rollers disposed in each of the through holes, respectively, with at least one of the rollers being a rolling pillar; during the rotation of the handle with respect to the rod body, when the rollers meet the position limiting grooves, the rollers are defined as in a lower status; when the rollers meet the rod wall between two neighboring position limiting grooves, the rollers are defined as in an ascend status;

a rotation ring having an axle bore and mounted on the plurality of rollers, the rotation ring being switched between a locked position and a relax position, the rotation ring having a plurality of allowance grooves disposed on an inner periphery of the rotation ring corresponding to each roller, each allowance groove being deepened along a direction from the locked position of the rotation ring toward the relax position of the rotation ring; when the rollers are in the lower status, the corresponding allowance grooves forcing the rollers toward the rod body by use of a shallow section of the allowance groove, and a deep section of the allowance provides an ascending space when the corresponding roller is in the ascend status; and a pressing member having a combination portion disposed at two opposite ends of the pressing member, respectively, the two combination portions being positioned at two sides of the extension tube, so as to mount the clamp ring on an outer periphery of the extension tube, whereby the pressing member keeps engaging an engagement portion of one of the rollers, such that the engaged roller is pressed toward the rod body by a prestress force supporting the pressing member, and the engaged roller is imposed with the prestress force to be lowering when meeting the corresponding position limiting groove, forming a switch sensation during the rotation of the handle with respect to the rod body.

With such configuration, when the user adjusts the torque value of the torque wrench, with an adjustment indication provided by the switch sensation produced by the rolling pillar, which is pressed by the pressing member, starts to lower when meeting the position limiting groove, the user is allowed to know that the torque scale is in alignment with the corresponding torque value, achieving an accurate torque value adjustment.

DETAILED DESCRIPTION OF THE INVENTION

Figure 1:
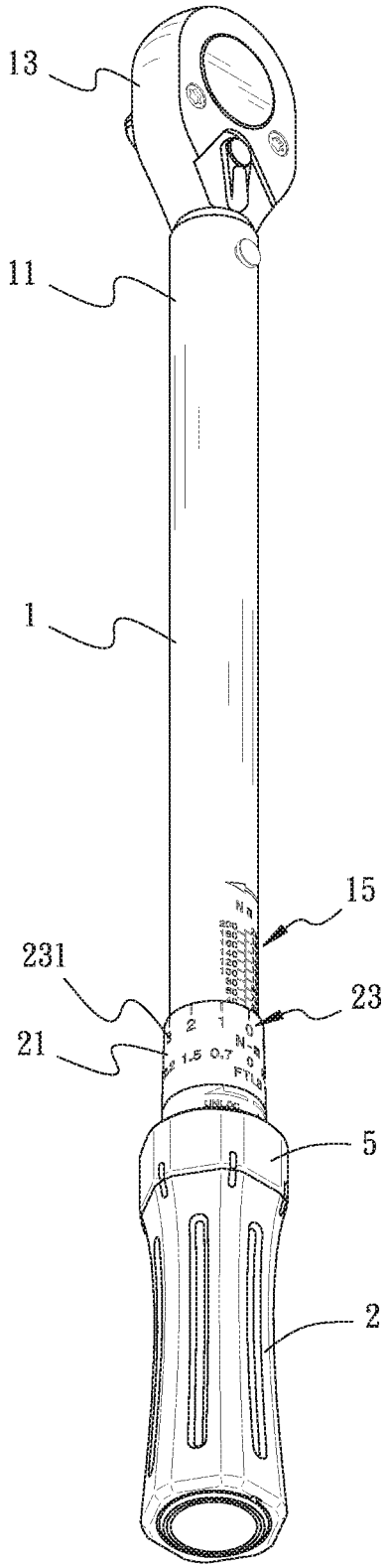
FIG. 1 is a perspective view of the wrench in accordance with an embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 8, a lockable torque wrench with adjustment indication in accordance with an embodiment of the present invention comprises a rod body 1, a handle 2, a rolling pillar 3, a rolling pillar 4, a rotation ring 5, and a pressing member. In a preferred embodiment, the pressing member is a clamp ring 6.

Figure 2:
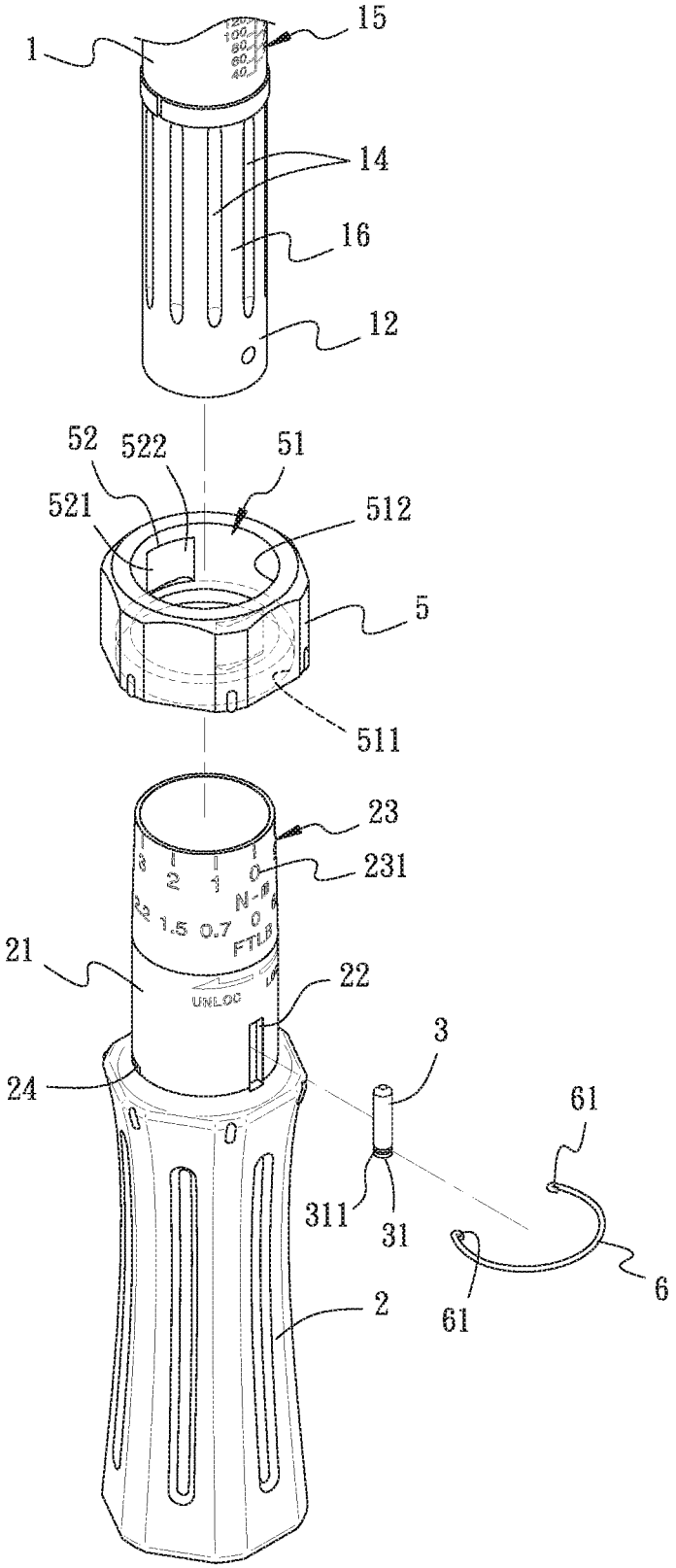
FIG. 2 is an exploded view of the handle portion of the wrench in accordance with an embodiment of the present invention.

Referring to FIG. 1 to FIG. 2, the rod body 1 is formed in an elongate rod having a first end 11 and a second end 12, with a driving head 13 disposed at the first end 11 of the rod body 1. Also, a plurality of position limiting grooves 14 are disposed at the outer periphery of the rod body 1 in adjacent to the second end 12. The position limiting grooves 14 are circularly mounted around the rod body 1, with an interval between each two neighboring position limiting grooves 14, wherein each interval between the two position limiting grooves 14 is formed of the rod wall 16 of the rod body 1. In an embodiment of the present invention, a total of ten position limiting grooves 14 are included. Each position limiting groove 14 is formed in an elongate shape and disposed along a length direction of the rod body 1.

Referring to FIG. 1 to FIG. 4, an extension tube 21 is disposed at one end of the handle 2. The second end 12 of the rod body 1 passes through the extension tube 21 to be combined into the handle 2. The rod body 1 rotates to extend or retract with respect to the handle 2, so as to adjust the torque for the operation of the driving head 13. In an embodiment of the present invention, the extension tube 21 has two through holes 22. Each through hole 22 is allowed to be arranged in alignment with each position limiting groove 14 along with the rotation of the handle 2 with respect to the rod body 1.

Referring to FIG. 1 and FIG. 2, in an embodiment of the present invention, each through hole 22 is also formed in an elongate shape, and disposed along a direction identical to the direction of the position limiting groove 14. Also, in an embodiment of the present invention, the rod body 1 has a torque scale value 15. When the rod body 1 rotates with respect to the handle 2 for one circular round, the extension amount of the rod body 1 with respect to the handle 2 is defined as one scale unit of the torque scale value 15, which is illustrated as the adjusted torque. In addition, in an embodiment of the present invention, another torque scale value 23 is disposed along an outer wall of the extension tube 21. The torque scale value 23 comprises ten scale units 231, such that the interval between each two neighboring scale units 231 is equal to the interval between each two position limiting grooves 14. The torque scale value 23 is applied for illustration during the fine tuning of the torque.

Figure 3:
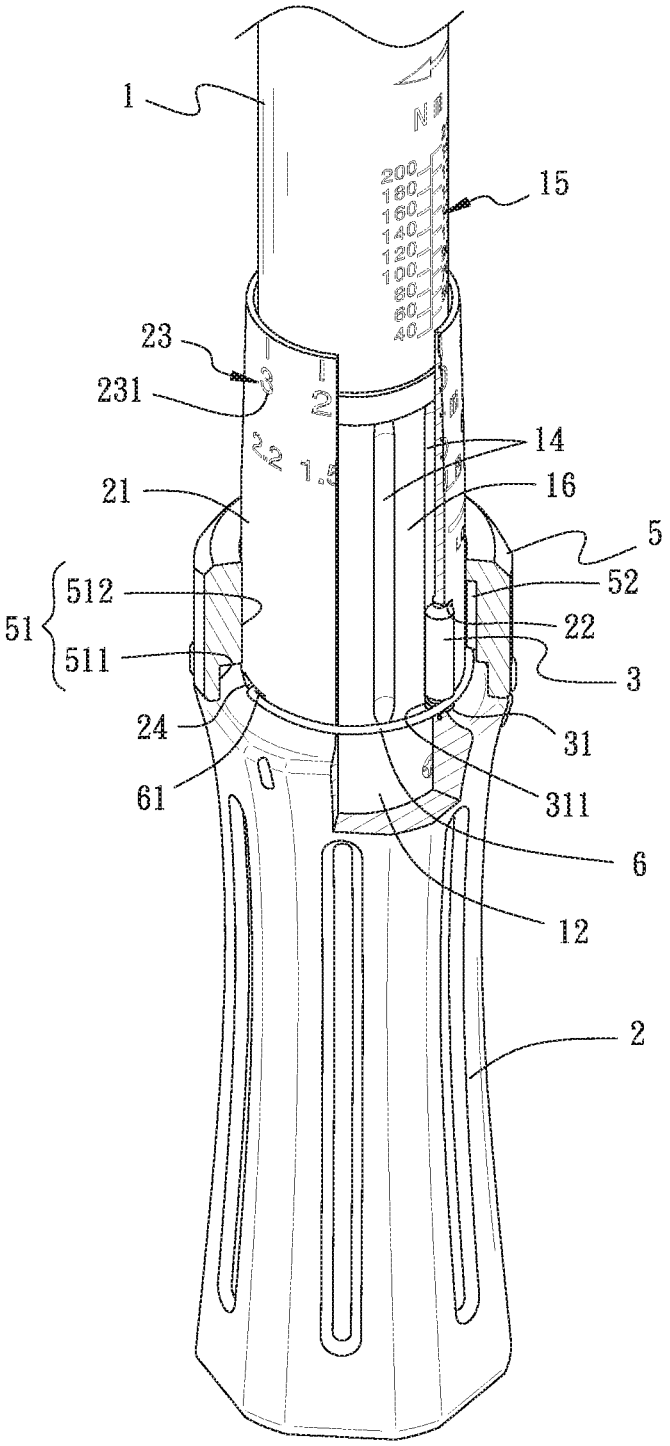
FIG. 3 is a partially perspective sectional view of the handle portion of the wrench in accordance with an embodiment of the present invention.
Figure 4:
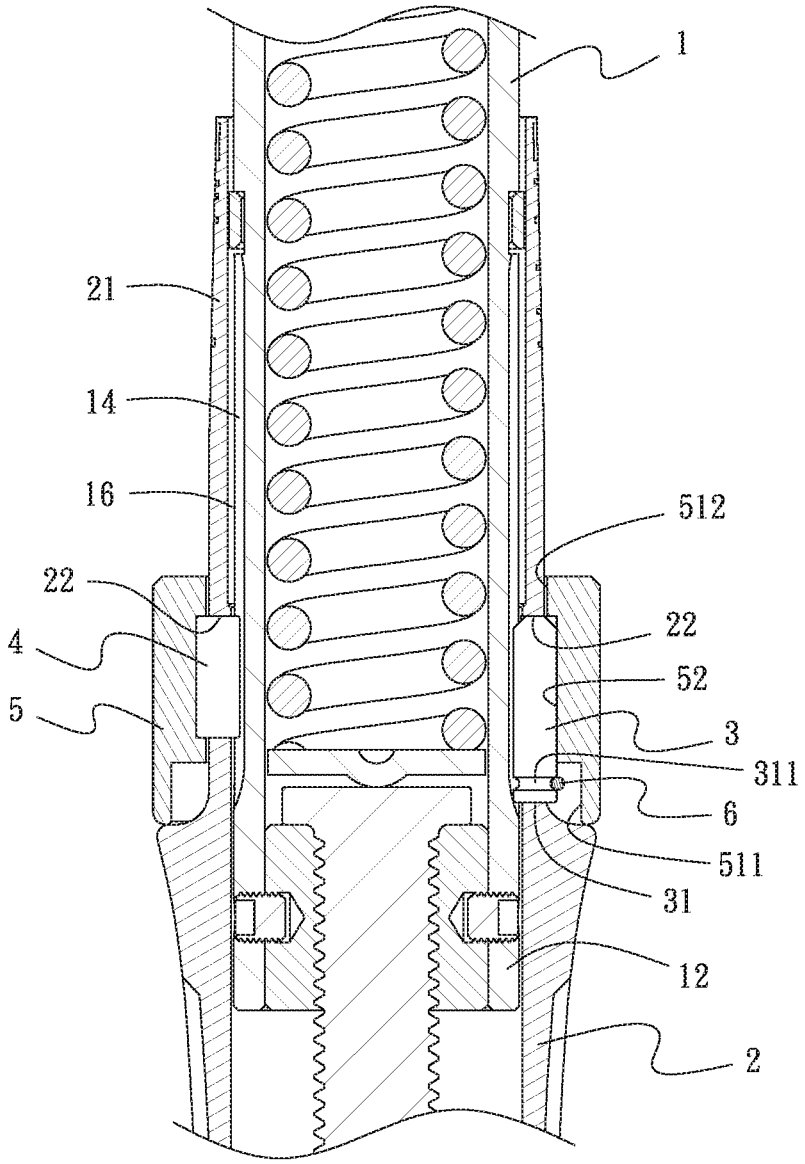
FIG. 4 is a partially cross-sectional view of the handle portion of the wrench in accordance with an embodiment of the present invention.

Referring to FIG. 3 and FIG. 4, the rolling pillar 3 and the rolling pillar 4 are disposed in one of the corresponding through holes 22, respectively. Also, in an embodiment of the present invention, the rolling pillar 3 and the rolling pillar 4 are disposed at two opposite sides of the extension tube 21. The rolling pillar 3 and the rolling pillar 4, during the rotation of the handle 2 with respect to the rod body 1, are in the lower status when placed in the position limiting grooves 14 (referring to FIG. 7 to FIG. 8) or in the ascend status when placed at the rod wall 16 between two neighboring position limiting grooves 14 (referring to FIG. 5 to FIG. 6). In an embodiment, length of the rolling pillar 3 is larger than the length of the rolling pillar 4, and length of the through hole 22 housing the rolling pillar 3 is larger than the length of the trough hole 22 housing the rolling pillar 4. In different embodiment, the rolling pillar 4 is allowed to be replaced by a rolling ball Therefore, the rolling pillar or rolling ball are considered as a specific concept of the term "roller".

Referring to FIG. 2 to FIG. 4, the rotation ring 5 has an axle bore 51 and is disposed on the extension tube 21 and mounted around the rolling pillar 3 and the rolling pillar 4. The rotation ring 5 is allowed to rotate with respect to the extension tube 21 to be positioned at a locked position (referring to FIG. 8) and a relax position (referring to FIG. 5 to FIG. 7). The rotation ring 5 has an allowance groove 52 disposed on the inner periphery of the rotation ring 5 corresponding to the rolling pillar 3 and the rolling pillar 4, respectively. Also, each allowance groove 52 is deepened along a direction from the locked position of the rotation ring 5 toward the relax position of the rotation ring 5. When the rolling pillar 3 and the rolling pillar 4 are in the lower status, the corresponding allowance grooves 52 force the rolling pillar 3 and the rolling pillar 4 toward the rod body 1 by the shallow section 521. When the rolling pillar 3 and the rolling pillar 4 are in the ascend status, the corresponding allowance grooves 52 provide an ascending space for the corresponding rolling pillar 3 and rolling pillar 4.

Figure 5:
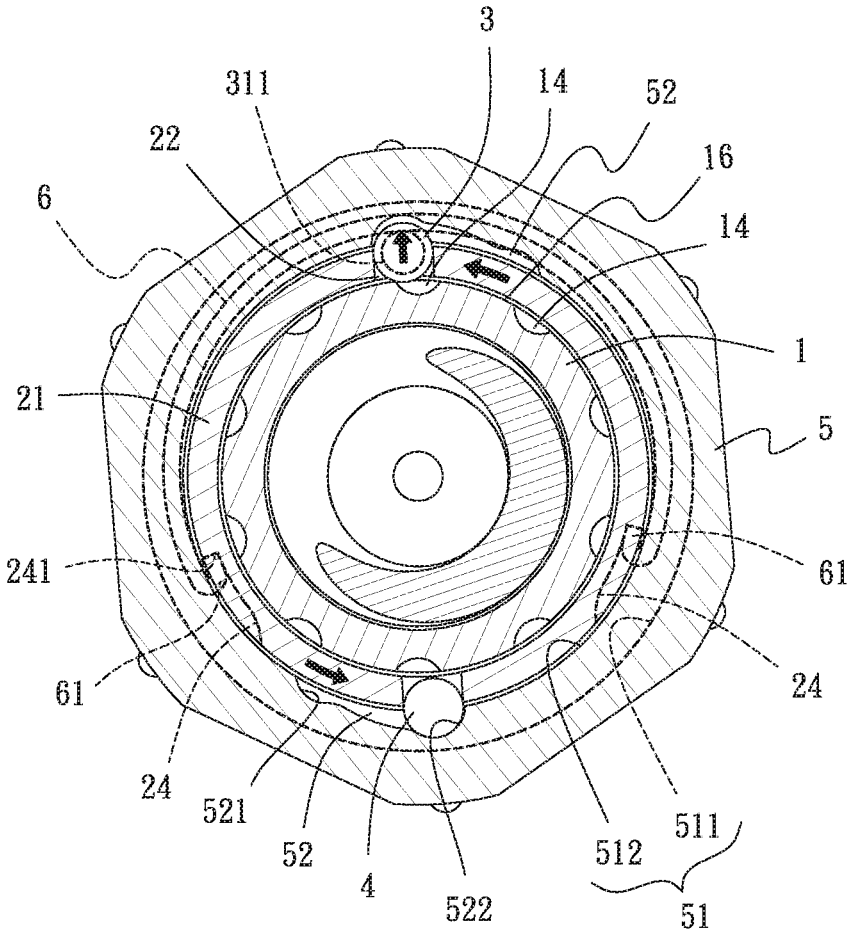
FIG. 5 is a schematic view illustrating the rotation ring being rotated to the relax position, with the extension tube rotated with respect to the rod body, such that the two rolling pillars ascend in the position limiting grooves.

Referring to FIG. 2, FIG. 3, and FIG. 5, the clamp ring 6 has a combination portion 61 disposed at two ends thereof, respectively, and the two combination portions 61 of the clamp ring 6 are positioned at two sides of the extension tube 21, respectively, so as to mount the clamp ring 6 on the outer periphery of the extension tube 21, whereby the clamp member 6 keeps engaging an engagement portion 31 of one of the rolling pillar 3. The engaged rolling pillar 3, in the ascend status, is pressed toward the rod body 1 by a prestress force supporting the clamp ring 6 (referring to FIG. 6), and the engaged rolling pillar 3 is imposed with the prestress force to be lowering when meeting the corresponding position limiting groove 14, forming a switch sensation during the rotation of the handle 2 with respect to the rod body 1. The switch sensation is provided with or without producing a sound, depending on the collision force of the rolling pillar 3 lowering in the position limiting groove 14.

In an embodiment of the present invention, the clamp ring 6 is integrally formed. The two combination portions 61 are formed by two opposite ends of the clamp ring 6 that are reversely bent into a hook shape. Two sides of the extension tube 21 are provided with a recess 24 corresponding to the combination portions 61, respectively. Also, a block face 241 is provided in the recess 24, and each block face 241 faces away from the rolling pillar 3. The clamp ring 6 keeps engaging the engagement portion 31, with each hook-shaped combination portion 61 resting against the block face 241 of the recess 24 to be positioned. In an embodiment of the present invention, only one rolling pillar 3 is engaged by the clamp ring 6. In other embodiments, a plurality of rolling pillars 3 having an engagement portion 31 are allowed to be engaged by the clamp ring 6 (not shown).

In an embodiment of the present invention, the engagement portion 31 is positioned at one end of the rolling pillar 3. The engagement portion 31 has a trench portion 311, such that the clamp ring 6 permanently engages the rolling pillar 3. Therein, the trench portion 311 is circularly and concavely disposed around the rolling pillar 3. Also, in an embodiment of the present invention, the axle bore 51 of the rotation ring 5 includes a large diameter section 511 and a small diameter section 512, wherein the diameter of the large diameter section 511 is greater than the diameter of the small diameter section 512. The allowance grooves 52 of the rotation ring 5 are disposed on the inner periphery of the small diameter section 512. The clamp ring 6 is formed in an arc shape and disposed at the large diameter section 511. Further, the outer peripheral length covered by the clamp ring 6 is larger than a half of the circumference of the extension tube 21.

With the foregoing configuration, when adjusting the torque value of the torque wrench in accordance with the present invention, the user rotates the rotation ring 5 to the relax position, and grips the handle 2 and the rod body 1, so as to rotate the handle 2 with respect to the rod body 1, aligning the end portion of the extension tube 21 of the handle 2 with the torque scale value 15 on the rod body 1. When fine tuning the torque value, during the rotation of the handle 2 with respect to the rod body 1, the user further aligns one of the scale units 231 of the torque scale value 23 on the extension tube 21 with the torque scale value 15 on the rod body 1. Finally, the user rotates the rotation ring 5 to the locked position, completing the torque adjustment process of the torque wrench.

Figure 6:
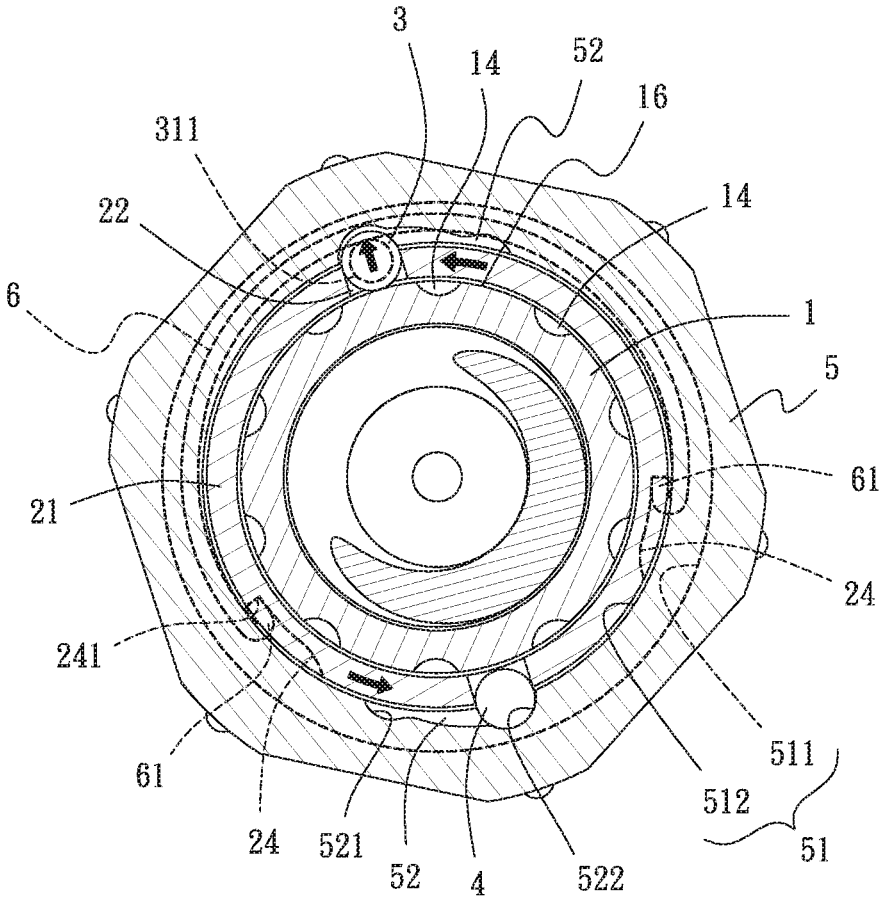
FIG. 6 is a schematic view illustrating that the extension tube in FIG. 5 continuously being rotated with respect to the rod body, and the rolling pillar clamped by the clamp ring being supported on the rod wall of the rod body.
Figure 7:
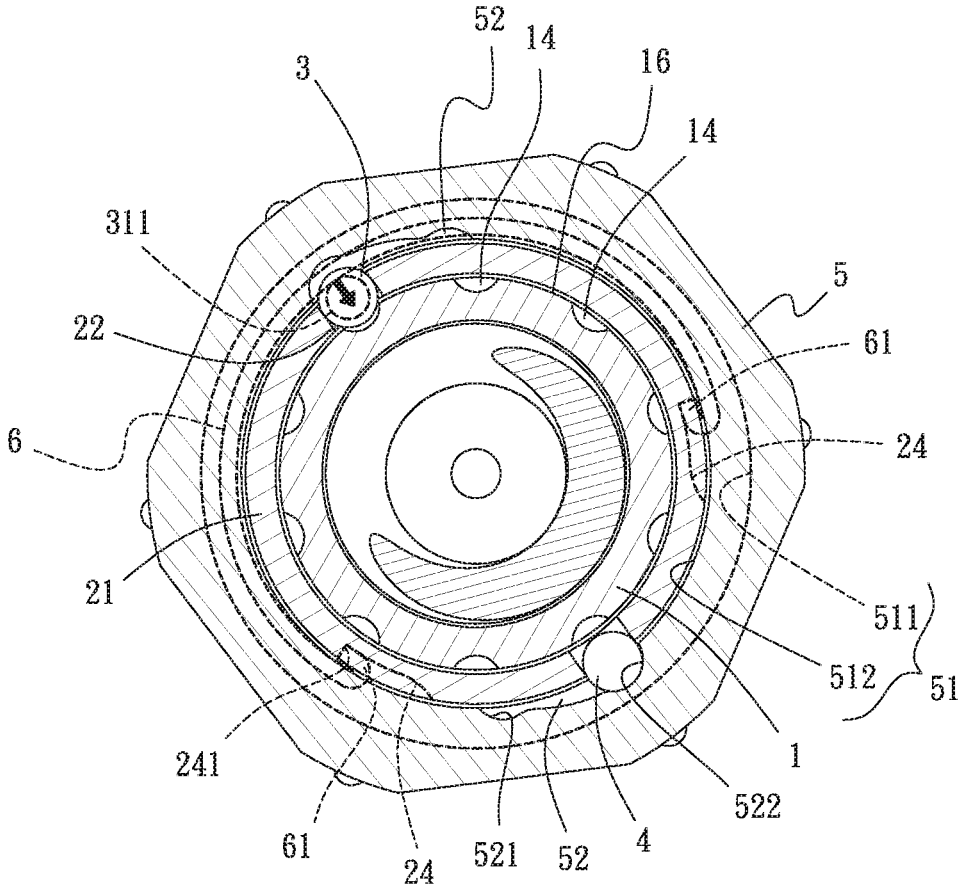
FIG. 7 is a schematic view illustrating that the extension tube in FIG. 6 continuously being rotated with respect to the rod body, and the rolling pillar clamped by the clamp ring lowering when being placed in the position limiting groove.
Figure 8:
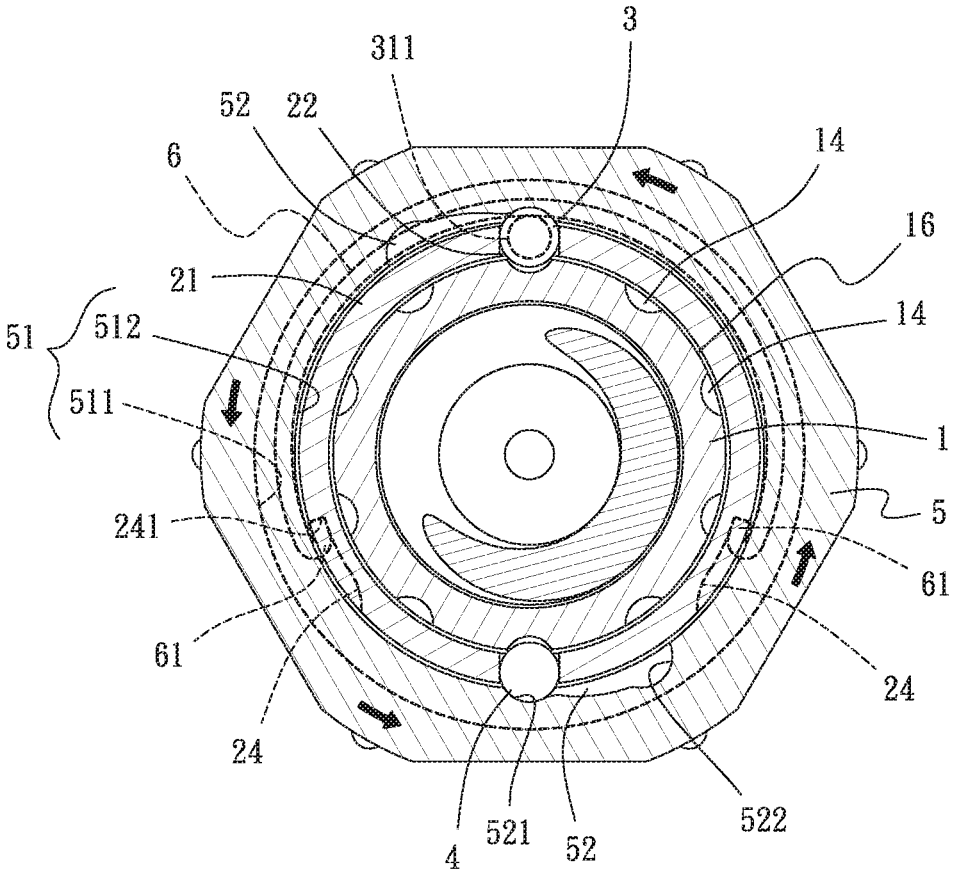
FIG. 8 is a schematic view illustrating the rotation ring being rotated to the locked position.

During the torque adjusting process, when the scale unit 231 is in alignment with the torque scale value 15 on the rod body 1, the rolling pillar 3 and the rolling pillar 4 in the through holes 22 are positioned in the position limiting grooves 14 in a lower status. When the handle 2 rotates with respect to the rod body 1, the rolling pillar 3 and the rolling pillar 4 ascend from the position limiting grooves 14 (as shown by FIG. 5 to FIG. 6). Meanwhile, due to the prestress force supporting the clamp ring 6, the rolling pillar 3 is pressed toward the rod body 1. With the handle 2 continuously rotating with respect to the rod body 1, when the rolling pillar 3 meets the next position limiting groove 14, the rolling pillar 3 is pressed by the aforementioned prestress force and lowers into the position limiting groove 14 (as shown by FIG. 7), causing an adjustment indication formed by the switch sensation provided by the rotational movement of the handle 2 with respect to the rod body 1. Thereby, the user is able to confirm that the selected scale unit 231 is in alignment with the torque scale value 15 on the rod body 1.

By use of such configuration, during the rotation of the handle 2 with respect to the rod body 1, when the roller (such as the rolling pillar 3 in the embodiment) ascends from the position limiting groove 14, the prestress force supporting the pressing member (clamp ring 6) presses the roller toward the rod body 1. When the roller meets the next position limiting groove 14, the roller lowers into the position limiting groove 14 due to the aforementioned prestress force presses, forming the adjustment indication formed by the switch sensation of the rotation of the handle 2 with respect to the rod body 1. Even if the scales (such as the scale unit 231) is worn after a long-period usage, the user is still allowed to confirm that the target torque is accurately selected. Therefore, the torque value is accurately adjusted. Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A lockable torque wrench with adjustment indication, comprising:

a rod body formed in an elongate rod and having a first end and a second end, with a driving head disposed at the first end, and a plurality of position limiting grooves disposed at an outer periphery of the rod body in adjacent to the second end, the plurality of position limiting grooves being circularly mounted around the rod body with an interval formed of a rod wall of the rod body disposed between each two of the position limiting grooves;

a handle having an extension tube at one end, the second end of the rod body passing through the extension tube to be combined into the handle, the rod body rotating with respect to the handle to extend or retract for adjusting a torque for the driving head to be operated with, the extension tube having a plurality of through holes, each of the through holes being respectively arranged in alignment with each position limiting groove during a rotation of the handle with respect to the rod body;

a plurality of rollers disposed in each of the through holes, respectively, with at least one of the rollers being a rolling pillar; during the rotation of the handle with respect to the rod body, when the rollers meet the position limiting grooves, the rollers are in a lower status; when the rollers meet the rod wall between two neighboring position limiting grooves, the rollers are in an ascend status;

a rotation ring having an axle bore and mounted on the plurality of rollers, the rotation ring being switched between a locked position and a relax position, the rotation ring having a plurality of allowance grooves disposed on an inner periphery of the rotation ring for the rollers, each allowance groove being deepened along a direction from the locked position of the rotation ring toward the relax position of the rotation ring, such that each allowance groove comprises a shallow section and a deep section; when the rollers are in the lower status, the corresponding allowance grooves forcing the rollers toward the rod body by use of the shallow section of the allowance groove, and the deep section of the allowance provides an ascending space when the corresponding roller is in the ascend status; and a pressing member having a combination portion disposed at two opposite ends of the pressing member, respectively, the two combination portions being positioned at two sides of the extension tube, so as to mount the pressing member on an outer periphery of the extension tube, whereby the pressing member keeps engaging an engagement portion of one of the rollers, such that the engaged roller is pressed toward the rod body by a prestress force supporting the pressing member, and the engaged roller is imposed with the prestress force to be lowering when meeting the corresponding position limiting groove, forming a switch sensation during the rotation of the handle with respect to the rod body;

wherein, the pressing member is a clamp ring, the two combination portions are formed by the two opposite ends of the clamp ring that are reversely bent into a hook shape, and two sides of the extension tube are provided with a recess corresponding to the combination portions, respectively, with a block face formed in each of the recesses, each block face facing away from the rolling pillar being engaged by the clamp ring; when the clamp ring keeps engaging the engagement portion of the rolling pillar, each hook-shaped combination portion resting against the block face of the recess to be positioned.

2. The torque wrench of claim 1, wherein the two combination portions are disposed at two opposite ends of the clamp ring, and the combination portions and the clamp ring are integrally formed.

3. The torque wrench of claim 2, wherein the engagement portion is disposed at one end of the rolling pillar, the engagement portion comprising a trench portion, such that the clamp ring keeps engaging the trench portion of the rolling pillar.

4. The torque wrench of claim 3, wherein the trench portion is circularly and concavely disposed around the rolling pillar.

5. The torque wrench of claim 1, wherein the axle bore comprises a large diameter section and a small diameter section, and a diameter of the large diameter section is greater than a diameter of the small diameter section, such that the allowance grooves of the rotation ring are disposed on an inner periphery of the small diameter section, and the clamp ring is formed in an arc shape and disposed at the large diameter section.

6. The torque wrench of claim 5, wherein an outer peripheral length of the extension tube covered by the clamp ring is larger than half of a circumference of the extension tube.

7. The torque wrench of claim 1, wherein each position limiting groove is formed in an elongate shape and disposed along a length direction of the rod body; each through hole is formed in an elongate shape and disposed along a direction identical to the direction of the position limiting grooves.

* * * * *